US006792993B1

(12) United States Patent
Forbes

(10) Patent No.: US 6,792,993 B1
(45) Date of Patent: Sep. 21, 2004

(54) AWNING TRAVEL LOCK

(76) Inventor: Wilson G. Forbes, 1804 State Orchard Rd., Council Bluffs, IA (US) 51503

( * ) Notice: Subject to any disclaimer, the term of this patent is extended or adjusted under 35 U.S.C. 154(b) by 0 days.

(21) Appl. No.: 10/313,544

(22) Filed: Dec. 7, 2002

(51) Int. Cl.[7] ..... E04F 10/06
(52) U.S. Cl. ..... 160/67; 160/78; 403/97
(58) Field of Search ..... 160/22, 67, 70, 160/78, 79; 403/93, 97

(56) References Cited

U.S. PATENT DOCUMENTS

| | | | | | |
|---|---|---|---|---|---|
| 866,073 | A | | 9/1907 | Saunders, Jr. | |
| 3,612,145 | A | * | 10/1971 | Darula et al. | 160/67 |
| 3,626,507 | A | | 12/1971 | Hawkins | 292/175 |
| 3,955,611 | A | * | 5/1976 | Coles et al. | 160/67 |
| 4,064,811 | A | * | 12/1977 | Copeland | 410/102 |
| 4,203,567 | A | * | 5/1980 | Featherstone | 248/108 |
| 4,524,791 | A | | 6/1985 | Greer | 135/89 |
| 4,602,889 | A | * | 7/1986 | Mu-Shan | 403/91 |
| 4,719,954 | A | | 1/1988 | Curtis et al. | 160/67 |
| 4,819,706 | A | | 4/1989 | Quinn | 160/67 |
| 4,997,021 | A | | 3/1991 | Brutsaert | 160/22 |
| 5,163,460 | A | | 11/1992 | Miller | 135/89 |
| 5,472,007 | A | | 12/1995 | Malott | 135/88.1 |
| 5,669,430 | A | | 9/1997 | Malott | 160/67 |
| 5,816,545 | A | * | 10/1998 | Malizia | 248/164 |
| 5,857,477 | A | | 1/1999 | James | 135/88.06 |
| 5,924,466 | A | * | 7/1999 | Kroner et al. | 160/78 |
| 6,076,867 | A | | 6/2000 | Dollman et al. | 292/174 |
| 6,098,693 | A | | 8/2000 | Frey, Jr. | 160/67 |
| 6,182,595 | B1 | * | 2/2001 | Morris | 114/259 |
| 6,230,582 | B1 | * | 5/2001 | Becker et al. | 74/545 |

* cited by examiner

*Primary Examiner*—Bruce A. Lev
(74) *Attorney, Agent, or Firm*—Thomte, Mazour & Niebergall; Shane M. Niebergall

(57) ABSTRACT

An awning lock mechanism for securing a collapsible awning. The lock mechanism is comprised of a lock housing and bracket that are coupled to an awning support member so that the lock mechanism is positioned closely adjacent the roller tube assembly when the awning is in its collapsed position. A locking pin selectively extends outwardly from the lock housing to be received by an opening formed in the roller tube assembly. In its locked position, the lock assembly substantially prevents the rotation of the roller tube assembly with respect to the support member. The lock member is then selectively moved to an unlocked position, allowing the deployment of the awning.

8 Claims, 3 Drawing Sheets

AWNING TRAVEL LOCK

BACKGROUND OF THE INVENTION

1. Field of the Invention

The present invention relates to locking mechanisms, and more particularly to a locking mechanism for securing conventional awnings, having a roller tube assembly, canopy, and supporting frame.

2. Description of the Related Art

Retractable awnings have become widely used in many recreational settings, from their use with recreational vehicles to their use with homes and patios, to create a relaxing shelter from the sun and rain. Retractable awnings are favored in these applications due to their ability to collapse into a tightly wound structure that is secured against the wall of the recreational vehicle or home. In this position, the awning neatly awaits its next intended use. However, wind is a common enemy to these awnings, especially when they are in collapsed, and seemingly safe, positions.

Wind that travels parallel to the awning structure is usually harmless, due to the shallow profile of the awning against a wall when it is in its collapsed position. However, gusts of wind that engage the awning in a perpendicular fashion exert potentially dangerous forces on the awning structure. In its collapsed position, the typical awning may be spaced away from the wall upon which it is secured a distance of three to four inches from the center of the roller tube. For an awning having a width of fifteen feet, an exposed surface of approximately five square feet is created. For an RV traveling at approximately 65 miles per hour, a 40-mile-per-hour gust of wind blowing perpendicular to the recreational vehicle will produce a vectored force equivalent to a 90-mile-per-hour gust of wind on the five square feet of exposed awning surface. Any slack in the rollup spring or play in the locking mechanism may cause a portion of the canopy to be exposed. The continued gusts of wind will cause the canopy to act like a sail and violently pull away from the wall it is secured to. Depending upon the road and weather conditions, and the speed in which the recreational vehicle is traveling, the flailing awning can cause a great amount of damage to the recreational vehicle and to vehicles traveling behind the recreational vehicle.

The awning locking mechanisms of the prior art typically employ a reversible ratchet, teeth and paul, and a rolling lobe, which depend on friction to secure the roller tube in place. U.S. Pat. Nos. 5,472,007 and 4,819,706 both disclose awnings that employ cam systems as the primary securement means for the awning. However, such friction means will always succumb to a variable force, such as the winds that gust into the exposed awning surfaces.

Many people typically fabricate crude backup systems for their awning locking mechanisms by securing the awning arms together using bungee cords or Velcro strips. Many people may also tie the awning arms to the fixture where the awning attaches to the recreational vehicle at the awning rail. Such systems offer a degree of security, but none of them will keep the canopy from billowing outwardly like a sail if the roller tube lock fails.

Other systems, such as that disclosed by U.S. Pat. No. 5,163,460, have been developed in order to prevent rotation of the roller tube while the awning is in its collapsed position. The '460 patent teaches a hook mechanism, that is pivotably connected to the roller tube and a catch mechanism, which is secured to the wall of the recreational vehicle. Once the awning is in its collapsed position, the hook is rotated so that it engages the catch mechanism. However, such a latching device depends upon the strength of its connection at both the roller tube and the wall of the recreational vehicle. Accordingly, those two points of connection, along with the engagement structure, create three potential failure sources that weaken the potential integrity of the latching mechanism.

Accordingly, what is needed is a latching mechanism that is simple in construction and operation that reliably secures an awning in its collapsed position.

SUMMARY OF THE INVENTION

The awning lock mechanism of the present invention is provided to secure an awning, having a canopy, a roller tube, and at least one support member, in a travel or collapsed position. The awning travel lock is generally provided with an elongated lock housing that is operatively coupled to a support member using an elongated lock bracket. The bracket is preferably angled so that, when the awning is in its collapsed position, the lock housing is positioned beneath the roller tube, adjacent one end thereof.

An elongated locking pin is disposed within the lock housing so that the locking pin may be moved, coaxially with the lock housing, between a locked position and an unlocked position. In its unlocked position, the locking pin is preferably substantially disposed within the lock housing. In its locked position, the locking pin extends outwardly from within the lock housing so that it is at least partially received within an opening formed in the roller tube. With the locking pin disposed within the roller tube, the roller tube is prevented from rotating with respect to the support member, thus substantially preventing the unrolling of the awning and the billowing of the canopy.

The locking pin is provided with a handle member that is manually engageable from one end of the lock housing, allowing the user to selectively move the locking pin between its locked and unlocked positions.

It is therefore one of the principal objects of the present invention to provide an improved awning lock mechanism for securing an awning in its collapsed position.

A further object of the present invention is to provide an awning lock mechanism that substantially prevents the rotation of the awning roller tube with respect to an awning support member when the lock mechanism is in its locked position.

Still another object of the present invention is to provide an awning lock mechanism that is simple in construction and operation.

Yet another object of the present invention is to provide an awning lock mechanism that works in conjunction with a locking mechanism of the awning's original design to secure the awning in its collapsed position.

Still another object of the present invention is to provide an awning lock mechanism that is easily manually engageable between its locked and unlocked positions.

A further object of the present invention is to provide an awning lock mechanism that can be used on virtually any design of conventional retractable awning.

These and other objects will be apparent to those skilled in the art.

DESCRIPTION OF THE PREFERRED EMBODIMENT

Figure 1:
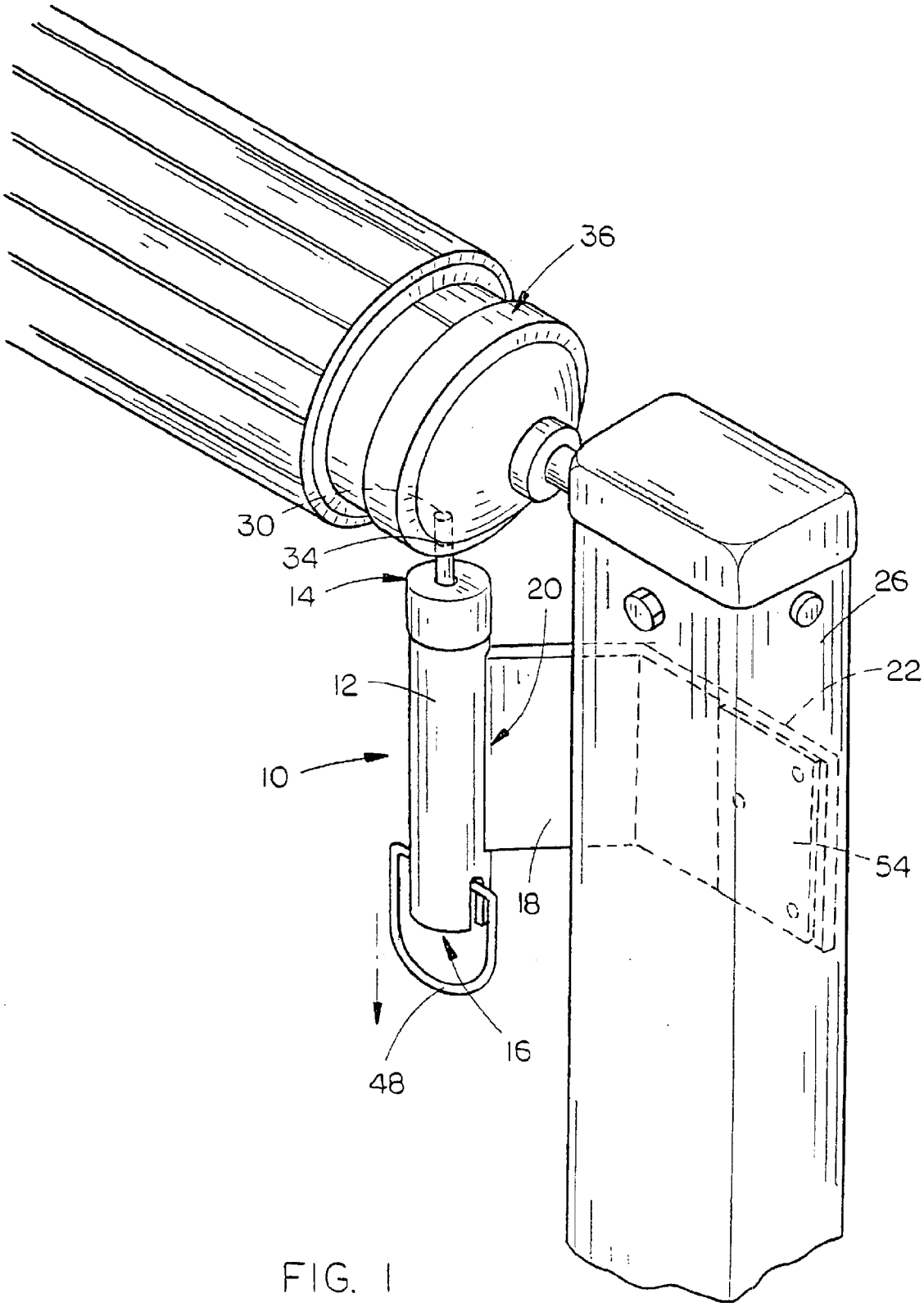
FIG. 1 is a perspective view of a preferred embodiment of the awning travel lock of the present invention.
Figure 2:
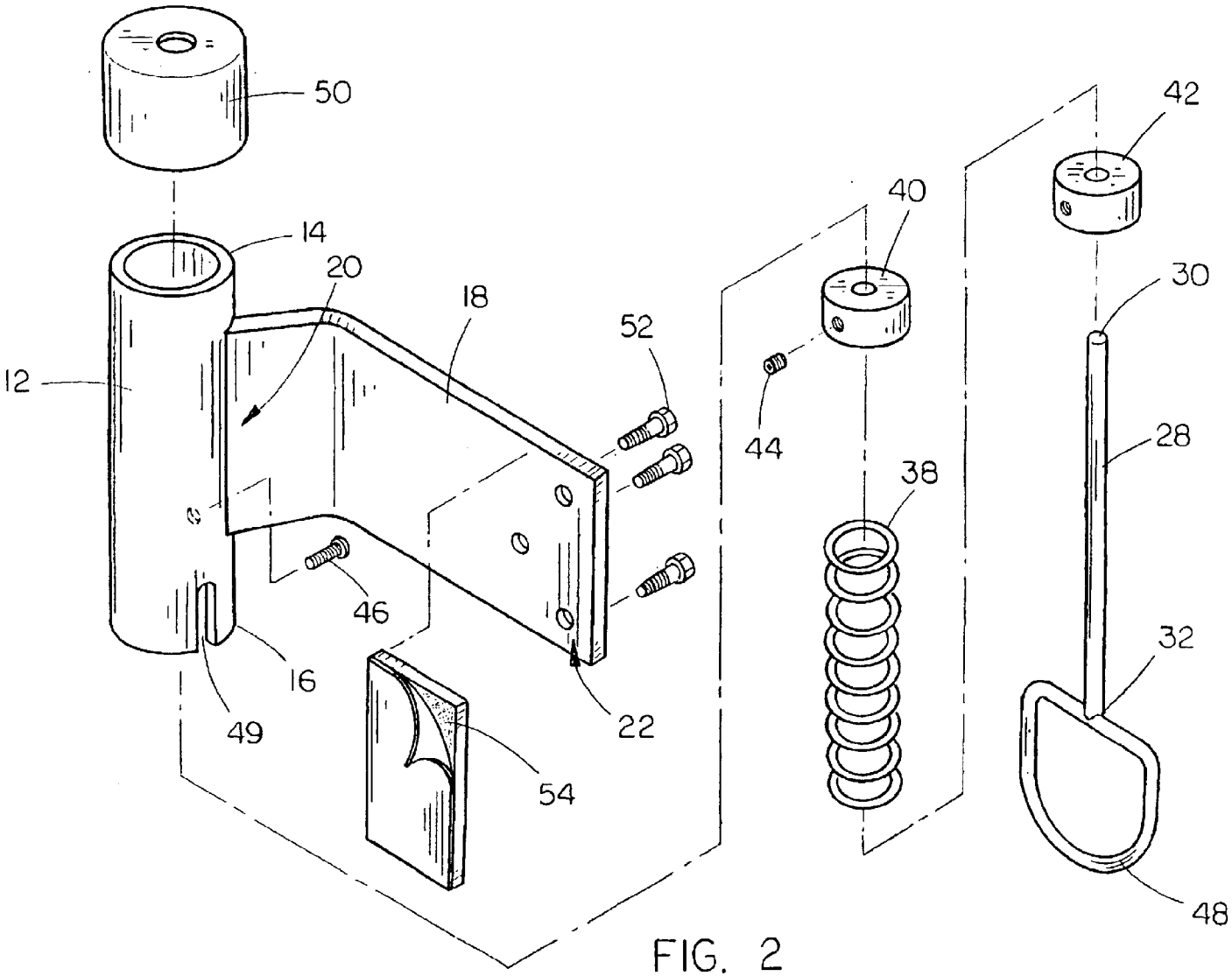
FIG. 2 is an exploded view of the awning travel lock of FIG. 1.
Figure 3:
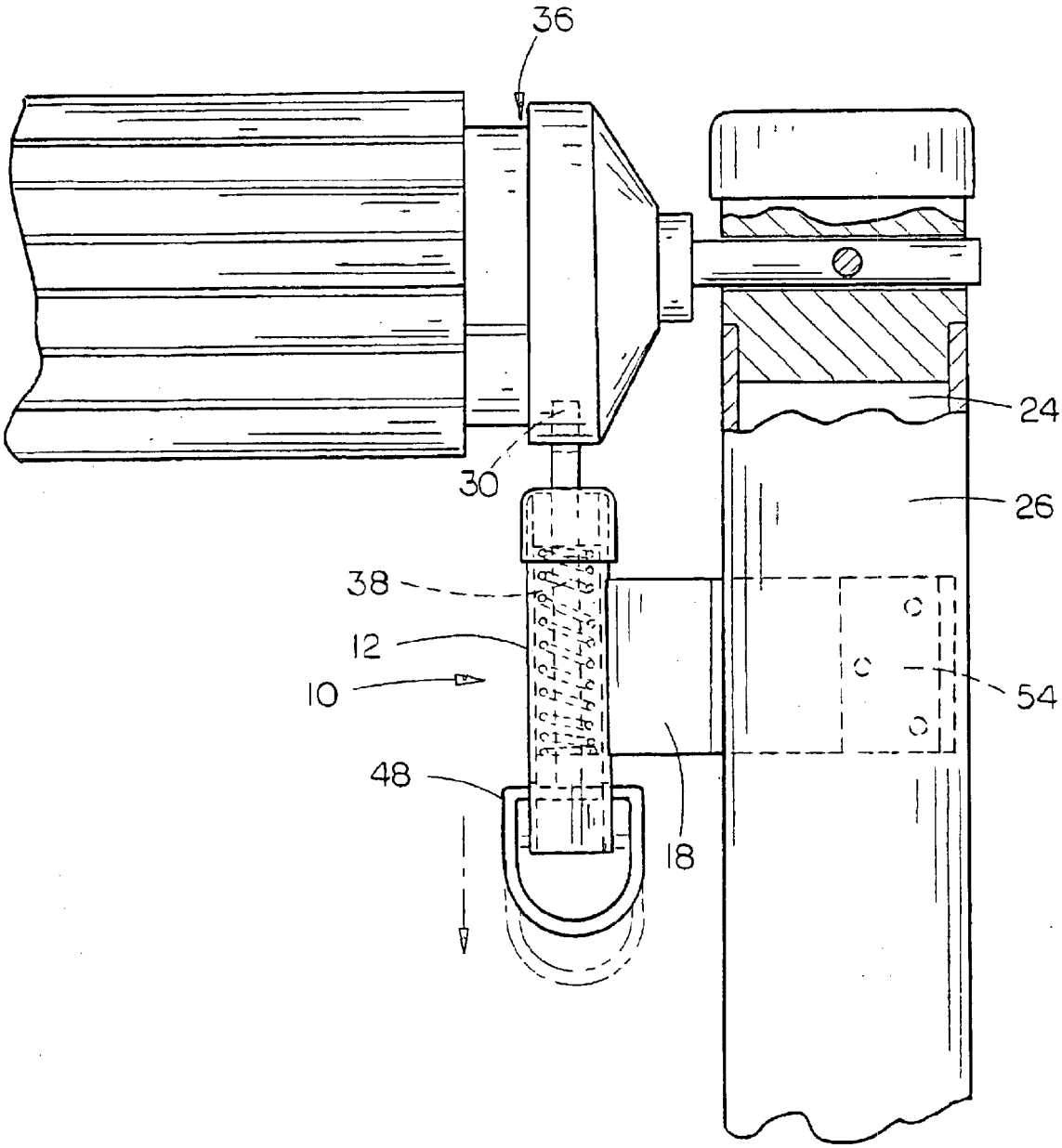
FIG. 3 is a front elevation view of the awning travel lock of FIG. 1.

The awning lock mechanism 10 of the present invention is depicted in FIGS. 1–3 as the same would be used to secure a conventional awning in a collapsed or retracted position. For simplicity's sake, the awning lock mechanism 10 will be described herein as the same would be used to secure an awning that is attached to a recreational vehicle. However, it is contemplated that the present invention could be used on virtually any design of awning in a limitless number of applications, such as those being coupled to a house, trailer home, or other such fixed and mobile structures.

The lock mechanism 10 is preferably provided with an elongated lock housing 12, having a first end 14 and a second end 16. The lock housing 12 is secured to an elongated locking bracket 18 having opposite end portions 20 and 22. In a preferred embodiment, the free end portion 22 of the locking bracket 18 is secured to the back of the awning rafter 24, which is positioned behind the awning arm 26 when the awning is in its collapsed position. It is contemplated, however, that the locking bracket 18 could be secured to the awning arm 26 rather than the rafter arm 24. Depending on the particular design of awning with which the lock mechanism 10 is to be used, it is typically unimportant which type of support member is secured to the locking bracket 18. However, the locking bracket 18 should be secured to the support member so that the lock housing 12 is positioned closely adjacent the roller tube assembly 36 when the awning is in its collapsed position. It is contemplated that the locking bracket 18 will be angularly shaped to properly position the locking mechanism 10, as shown in FIGS. 1 and 3.

The locking mechanism 10 is further provided with a locking pin 28 having a first end 30 and a second end 32. The locking pin 28 is coaxially movably secured within the lock housing 12 so that the locking pin 28 can be selectively moved between locked and unlocked positions. In the unlocked position, the locking pin 28 will preferably be substantially disposed within the lock housing 12 so that the first end 30 of the locking pin 28 will be disengaged from the roller tube assembly 36. In the locked position, the locking pin 28 will extend at least partially beyond the first end portion 14 of the lock housing 12. In this position, the first end portion 30 of the locking pin 28 will be received within the roller tube assembly 36, via an opening 34 formed therein. In the locked position, the roller tube assembly 36 is substantially prevented from rotating with respect to either the rafter arm 24 or the awning arm 26.

In a preferred embodiment, a spring 38 is disposed within the lock housing 12 to supply a force that continually urges the locking pin 28 in a locked position. A first stop 40 is disposed within the lock housing 12 adjacent the first end 14. A second stop 42 is disposed within the lock housing 12 adjacent the second end 16. The spring 38 is disposed between the first stop 40 and the second stop 42. A first set screw 44 is disposed through the first stop 40 so that it engages the locking pin 28 as the locking pin 28 is positioned through the first stop 40. In this arrangement, the first stop 40 is selectively movable within the lock housing 12 with the locking pin 28 as the same is moved between its locked and unlocked positions. The second stop 42 is secured in position with respect to the lock housing 12 using a second set screw 46. Accordingly, as the locking pin 28 is manually or mechanically withdrawn from the lock housing 12 through its second end 16 using the handle portion 48 disposed at the second end portion 32 of the locking pin 28, the spring 38 is compressed between the first stop 40 and the second stop 42.

It is contemplated that the handle portion 48 can be formed to have virtually any known shape. However, it is preferred that the shape of the handle 48 be provided so that it can be selectively positioned to secure the locking pin 28 in its locked or unlocked positions. For example, the D-shape of the handle 48 depicted in FIGS. 1–3 enables the handle 48 to be received within the slot 49 formed in the second end portion 16 of the lock housing 12 when the locking pin 28 is in its locked position. When the locking pin 28 is sufficiently withdrawn from the lock housing 12, through its second end portion 16, the handle 48 can be rotated so that the handle 48 cannot be withdrawn into the slot 48. Accordingly, the shape of the handle 48 and the lock housing 12 have allowed the lock mechanism 10 to be selectively secured in its locked and unlocked positions. It is contemplated that the shape of both the handle 48 and the lock housing 12 will vary according to the particular desired application and degree of position securement that is desired.

A cap member 50 is generally provided to be disposed at the first end 14 of the lock housing 12 to substantially prohibit water and debris from collecting within the lock housing 12. However, it is contemplated that the lock housing 12 could be integrally formed with a substantially closed end portion 14, obviating the necessity of a cap member 50. Similarly, it is contemplated that the first stop 40 could be integrally formed with the locking pin 28, and the second stop 42 could be integrally formed with the lock housing 12. Alternative resilient members are also contemplated to be used in lieu of the spring 38. The number and shapes of springs, as well as the materials used to form the same, can be modified according to the desired application.

It is contemplated that the lock mechanism 10 of the present invention could be used as an after-market product to be used in conjunction with the locking mechanism of the awning's original design. As an after-market product, it is contemplated that the locking bracket 18 will be coupled to the awning rafter 24 or the awning arm 26 using a plurality of self-tapping screws 52. However, it is contemplated that other securement methods, such as welding, riveting, or other such means known in the art could be used. To assist the user in securing the awning bracket 18 to the support member, an adhesive member 54 could be provided on the mounting surface of the locking bracket 18 adjacent the free end portion 22. The adhesive member 54 will allow the user to temporarily secure the locking mechanism 10 in position while the more permanent means is employed.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. In combination:

an awning assembly movable between use and storage positions comprising a canopy, a roller, and at least one support member, said roller being rotatably coupled to said at least one support member; and a locking device comprising a lock housing, having forward and rearward end portions, operatively coupled to said at least one support member so that said lock housing is positioned adjacent said roller when said awning assembly is in said storage position, and a lock pin having opposite forward and rearward end portions operatively connected to said lock housing;

said lock pin being movable between locked and unlocked positions with respect to said lock housing and said roller;

said lock pin having a handle disposed at the rearward end portion of said lock pin to facilitate movement of said lock pin between said locked and unlocked positions;

said rearward end portion of said lock housing being shaped to have at least one channel formed therein to at least partially receive the handle of said lock pin and selectively retain said lock pin in said locked and unlocked positions;

said lock pin being shaped to be at least partially removably received within an opening formed in said roller to selectively substantially prevent the rotation of said roller.

2. The combination of claim 1 wherein said locking device is further comprised of means for biasing said lock pin in the direction of said locked position.

3. The combination of claim 2 wherein said means for biasing is comprised of a spring.

4. The combination of claim 1 wherein said locking device is further comprised of an adhesive member for temporarily adhering said locking device to said at least one support member.

5. A method of securing an awning, having at least a canopy, a roller assembly and at least one support member, in a collapsed position, comprising the steps of:

providing a locking device comprising a lock housing, having forward and rearward end portions and a channel formed within said rearward end portion, and a lock pin, having opposite forward and rearward end portions and a handle at said rearward end portion, that is selectively movable between locked and unlocked positions with respect to said lock housing;

forming an opening in the roller assembly;

operatively coupling said lock housing to the at least one support member so that said lock housing is positioned closely adjacent said opening formed in the roller assembly when the awning is in the collapsed position;

positioning the awning in the collapsed position; and moving said lock pin into said locked position so that the forward end portion of said lock pin is at least partially received within said opening formed in said roller assembly and said handle, at said rearward end portion of said lock pin, is at least partially received within the channel formed within the rearward end portion of said lock housing.

6. The method of claim 5 further comprising the step of providing an elongated bracket to operatively couple said lock housing to the at least one support member so that said locking device is positioned transversely with respect to the roller assembly.

7. The method of claim 6 further comprising the step of providing an adhesive member on said elongated bracket and first temporarily securing said elongated bracket to the at least one support member with said adhesive member prior to the step of operatively connecting said lock housing to the at least one support member.

8. The method of claim 5 further comprising the step of providing means for biasing said lock pin in said locked position.

* * * * *